US009725289B2

(12) United States Patent
Panio et al.

(10) Patent No.: US 9,725,289 B2
(45) Date of Patent: Aug. 8, 2017

(54) HYDRAULIC LIFTING APPARATUS

(71) Applicant: HLBP DESIGN CORP., Pelham, NY (US)

(72) Inventors: Michael T. Panio, Whitestone, NY (US); Jeffrey Baynon, Pelham, NY (US)

(73) Assignee: HLBP DESIGN CORP., Pelham, NY (US)

( * ) Notice: Subject to any disclaimer, the term of this patent is extended or adjusted under 35 U.S.C. 154(b) by 340 days.

(21) Appl. No.: 14/245,174

(22) Filed: Apr. 4, 2014

(65) Prior Publication Data

US 2014/0301819 A1 Oct. 9, 2014

Related U.S. Application Data

(63) Continuation-in-part of application No. 13/621,513, filed on Sep. 17, 2012, which is a continuation-in-part of application No. 12/880,824, filed on Sep. 13, 2010, now abandoned.

(51) Int. Cl.
*B66F 19/00* (2006.01)

(52) U.S. Cl.
CPC ..... *B66F 19/005* (2013.01)

(58) Field of Classification Search
CPC . B66F 19/005; B66C 1/62; B66C 1/64; B66C 1/66
See application file for complete search history.

(56) References Cited

U.S. PATENT DOCUMENTS

| | | | |
|---|---|---|---|
| 1,716,188 | A | 6/1929 | Anthony |
| 1,822,629 | A | 9/1931 | McIlvried |
| 1,957,719 | A | 5/1934 | Naugle et al. |
| 2,554,433 | A | 5/1951 | Warren |
| 2,747,535 | A | 5/1956 | Curry |
| 2,946,618 | A | 7/1960 | Klahn et al. |
| 2,951,725 | A | 9/1960 | St. Jean |
| 3,035,336 | A | 5/1962 | McConnell |
| 3,164,406 | A | 1/1965 | Barry |
| 3,627,157 | A | 12/1971 | Blatchly |

(Continued)

FOREIGN PATENT DOCUMENTS

| | | | |
|---|---|---|---|
| DE | 1228380 | B | 11/1966 |
| GB | 1500632 | A | 2/1978 |

(Continued)

*Primary Examiner* — Joseph J Hail
*Assistant Examiner* — Joel Crandall
(74) *Attorney, Agent, or Firm* — Venable LLP; Steven J. Schwarz; F. Brock Riggs

(57) ABSTRACT

A lifting apparatus for lifting a manhole cover includes a first frame section with a first end assembly that supports a hook to engage a lifting block on a manhole cover, and a second frame section with a second end assembly that supports a hook to engage a lifting block on the manhole cover. At least one of the first and second end assemblies is movable, via an actuator, with respect to the other to change a distance between hooks. The hooks are movable in a way that the hooks engage with the lifting blocks on an adjacent manhole cover. The first frame section is coupled to the second frame section during a lifting operation, and the first and second frame sections are selectively detachable from one another when not in use.

20 Claims, 12 Drawing Sheets

(56) References Cited

U.S. PATENT DOCUMENTS

| | | | | |
|---|---|---|---|---|
| 3,695,667 | A | 10/1972 | Dempsey | |
| 3,695,670 | A | 10/1972 | Barnett et al. | |
| 3,797,676 | A | 3/1974 | McCarthy | |
| 3,861,649 | A | 1/1975 | Mosley | |
| 3,899,205 | A | 8/1975 | Lanigan et al. | |
| 4,136,903 | A | 1/1979 | Roethler | |
| 4,181,290 | A * | 1/1980 | Affolter | B66F 19/005 254/124 |
| 4,252,358 | A | 2/1981 | Klebs | |
| 4,256,429 | A | 3/1981 | Dwyer | |
| 4,482,182 | A | 11/1984 | Mortensen | |
| 4,488,706 | A | 12/1984 | Kono | |
| 4,563,031 | A * | 1/1986 | Kishimoto | B66C 1/62 294/81.21 |
| 4,826,388 | A | 5/1989 | Golding | |
| 4,928,927 | A | 5/1990 | Fredrick et al. | |
| 4,973,094 | A | 11/1990 | Tana et al. | |
| 4,991,893 | A | 2/1991 | Gordon et al. | |
| 5,141,386 | A | 8/1992 | Barwise | |
| 5,165,661 | A | 11/1992 | Wright | |
| 5,338,150 | A | 8/1994 | Focke et al. | |
| 5,403,057 | A | 4/1995 | Sugito et al. | |
| 5,429,490 | A | 7/1995 | Myers et al. | |
| 5,458,435 | A | 10/1995 | Kohno | |
| 5,997,064 | A | 12/1999 | Orita | |
| 6,019,565 | A | 2/2000 | Gesuale | |
| 6,439,628 | B1 | 8/2002 | Eslambolchi et al. | |
| 6,595,566 | B1 | 7/2003 | Donnan | |
| 6,749,392 | B1 | 6/2004 | Adams et al. | |
| 6,964,407 | B1 | 11/2005 | Butler | |
| 7,387,463 | B2 | 6/2008 | Winn, Jr. | |
| 7,562,923 | B2 | 7/2009 | Han et al. | |
| 8,226,140 | B1 | 7/2012 | Dietrich et al. | |
| 8,444,366 | B2 | 5/2013 | Cole | |
| 2001/0032972 | A1 | 10/2001 | Fillisetti | |
| 2004/0135389 | A1 | 7/2004 | Helms | |
| 2006/0118653 | A1 | 6/2006 | Shivak | |
| 2008/0159810 | A1 | 7/2008 | Myers | |

FOREIGN PATENT DOCUMENTS

| | | | |
|---|---|---|---|
| GB | 2109766 | A | 6/1983 |
| GB | 2219984 | A | 12/1989 |
| GB | 2415007 | A | 12/2005 |
| JP | 06136775 | A | 5/1994 |
| JP | 11323984 | B1 | 11/1999 |

* cited by examiner

HYDRAULIC LIFTING APPARATUS

CROSS-REFERENCE TO RELATED APPLICATION

The present application is a continuation-in-part of copending U.S. patent application Ser. No. 13/621,513, filed Sep. 17, 2012, which is a continuation-in-part of U.S. patent application Ser. No. 12/880,824, filed Sep. 13, 2010 (now abandoned), the entire contents of both applications are hereby incorporated by reference.

FIELD OF INVENTION

The invention relates in general to a lifting apparatus and, more particularly, to a lifting apparatus used to lift manhole covers, street gratings, and the like.

BACKGROUND OF INVENTION

Underground utility installations (such as sewer pipes, electrical cable conduits, and the like) have become increasingly complex. This increasing complexity often requires frequent access by construction or maintenance personnel in order to install new utilities or upgrade and maintain existing utilities. Since these utility installations are located underground, access to them is generally accomplished through an entrance hole set at ground level. Personnel typically descend through the entrance hole into a vertical access conduit that permits access to the utility installations. These access conduits are commonly referred to as "manholes."

The entrance hole of the access conduit is usually closed with some type of cover, such as a manhole cover or grating. These manhole covers can be of different shapes and sizes (circular, rectangular, etc.) depending upon the degree of access required or the type of access conduit that is in use. To ensure safety, security, and durability, manhole covers are typically constructed of a rigid material, such as cast iron. As a result, the manhole covers can be very heavy and difficult to lift, and may pose a safety risk to personnel who attempt to remove a manhole cover for entry into an access conduit.

One particular problem associated with lifting manhole covers is the danger associated with gas build-up within the access conduit under certain circumstances. Removal of the manhole cover may cause ignition of the gas, resulting in an explosion. Any personnel who are in close proximity to the access conduit therefore face severe danger and the possibility of extreme injury. Accordingly, there is a need for an apparatus that provides efficient and convenient manhole cover removal and replacement and at the same time keeps personnel safe by allowing such removal and replacement to be performed by personnel from a sufficient distance from the manhole cover and access conduit. In particular, there is a need for an apparatus that may be used to remove and replace manhole covers.

The invention described herein is intended to addresses the above needs. In particular, it is an objective of the invention to provide an apparatus that facilitates the efficient and convenient removal and replacement of manhole covers. Another objective of the invention is to permit personnel to safely perform such removal and replacement from a sufficient distance from the manhole cover and the access conduit. To achieve these and other objectives, the invention provides a lifting apparatus that permits safe and convenient removal and replacement of a manhole cover.

SUMMARY OF INVENTION

According to an embodiment of the present invention, a lifting apparatus for lifting a manhole cover includes a first frame section having a first end assembly that supports a hook adapted to engage a corresponding lifting block on a manhole cover, and a second frame section having a second end assembly that supports a hook adapted to engage a corresponding lifting block on the manhole cover. At least one of the first and second end assemblies is movable with respect to the other of the first and second end assemblies to change a distance between the hooks of the first and second end assemblies. The lifting apparatus also includes an actuator to move at least one of the first and second end assemblies to increase the distance between the hooks such that the hooks engage with the lifting blocks on an adjacent manhole cover. The first frame section is coupled to the second frame section during a lifting operation, and the first and second frame sections are selectively detachable from one another when not in use.

According to another embodiment of the present invention, a lifting apparatus for engaging a manhole cover includes a first pair of generally parallel longitudinal members of a selected length, and a second pair of generally parallel longitudinal members of a selected length. The second pair of longitudinal members may be coupled to the first pair of longitudinal members during a lifting operation, and selectively detachable from the first pair of longitudinal members when not in use. The apparatus may further include a pair of generally parallel lateral assemblies. Each of the pair of generally parallel lateral assemblies may be respectively coupled to and spacing one of the first or second pair of longitudinal members, and at least one of the lateral assemblies may be movable along a portion of the length of one of the first or second pair of longitudinal members. The apparatus may also include at least one hook supported by each lateral assembly for engagement with a corresponding lifting block provided at a face of a manhole cover, and an actuation device for moving the at least one movable lateral assembly along a portion of the length of the first or second pair of longitudinal frame members to increase a spacing between the lateral assemblies such that the hooks engage with the corresponding lifting blocks and secure the lifting apparatus to the manhole cover.

According to another embodiment of the present invention, a method for removing a manhole cover from an access conduit is provided. The method may include providing a lifting apparatus that includes a first frame section having a first end assembly, and a second frame section configured to be coupled to the first frame section and having a second end assembly. Each of the first and second frame sections may support a hook adapted to engage a corresponding lifting block, and at least one of the first and second end assemblies may be movable with respect to the other end assembly to change a distance between the hooks. The apparatus may also include an actuator for moving the at least one movable end assembly. The method may further include coupling the first frame section to the second frame section prior to removing the manhole cover, positioning the lifting apparatus adjacent to a manhole cover including a plurality of lifting blocks, and activating the actuator to increase the distance between the hooks to engage the hooks with the lifting blocks on the adjacent manhole cover. The method may also include raising the lifting apparatus after the hooks are engaged with the lifting blocks to lift the manhole cover.

BRIEF DESCRIPTION OF DRAWINGS

The features, objects, and advantages of the inventions of this invention will become more apparent from the detailed description set forth below when taken in conjunction with the drawings in which like reference characters identify correspondingly throughout and wherein.

DETAILED DESCRIPTION OF THE INVENTION

The principles of the present invention and their advantages are best understood by referring to the illustrated embodiment depicted in FIGS. 1-11 of the drawings, in which like numbers designate like parts.

Examples of embodiments of the current invention can be seen in THE NORTON™ by E. Norton & Associates, Corp.

Figure 1:
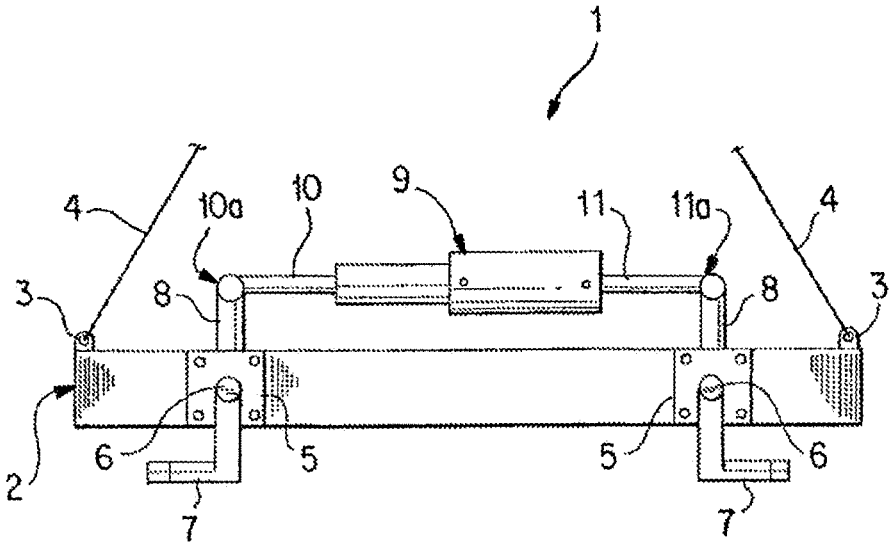
FIG. 1 is a side view of a lifting apparatus in accordance with one embodiment of the invention.
Figure 2:
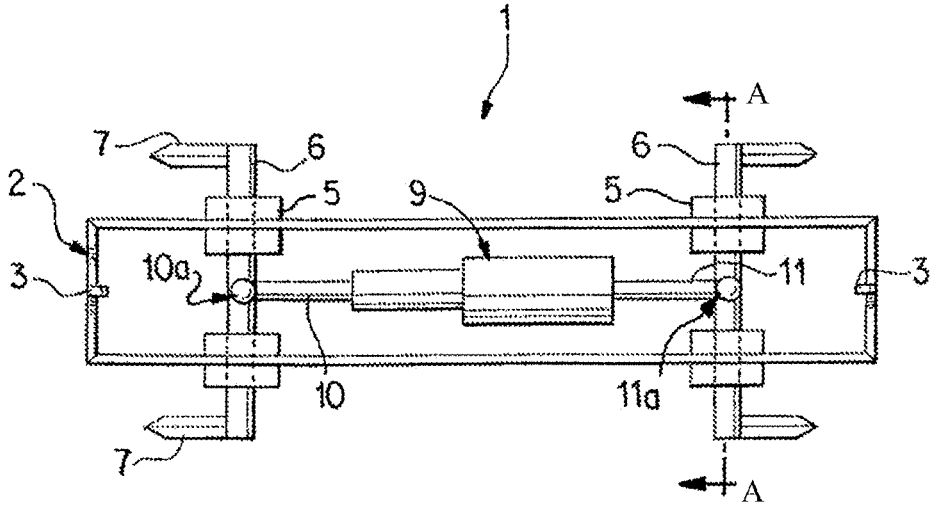
FIG. 2 is a top view of the lifting apparatus shown in FIG. 1.

A lifting apparatus 1 in accordance with one embodiment of the invention is shown in FIGS. 1 and 2. Lifting apparatus 1 includes a lifting member 2. Lifting member 2 may be of any suitable construction. In the embodiment of the lifting apparatus 1 shown in FIGS. 1 and 2, the lifting member 2 has an elongated box-type structure, constructed of four steel plates fastened together in a suitable fashion, for example, by welding. Alternatively, lifting member 2 could be constructed of a frame that includes tubular members. Lifting member 2 preferably includes a plurality of lifting points 3 to which an appropriate rigging structure may be affixed in order to lift the complete lifting apparatus 1 with rigging or lifting equipment, such as, a crane. For example, rigging lines 4 may be attached to lifting points 3. Rigging lines 4 may be constructed of steel wire, chain, or any other suitable material known in the art.

Fastened to the lifting member 2 are a plurality of bearing plates 5. Bearing plates 5 may be fastened to lifting member 2 with bolts (as shown), by welding, or may be integral with the steel plates that form the lifting member 2. As shown in FIG. 2, rods 6 are positioned through holes in the bearing plates 5 and corresponding holes of the steel plates that form the long sides of lifting member 2. Appropriate means (not shown) to secure the rods 6 in the axial direction may be incorporated as is well known in the art. Rods 6 may be of any suitable cross-sectional shape, such as, for example, round, square, or hexagonal.

Affixed to the rods 6 in a suitable fashion, such as, for example, by welding, are a plurality of lifting hooks 7 that may extend in the downward direction (e.g., towards the ground). Alternatively, lifting hooks 7 may removable from the rods 6 in a manner that permits disconnection and replacement with either a new lifting hook 7 of the same type, or a hook of a different type, depending upon the size of the manhole cover being lifted by the lifting apparatus 1 or the particular location and structure of pockets 13 and lifting blocks 14 that are integral with the manhole cover, as shown, for example, on manhole cover 12 in FIG. 4. Lifting hooks 7 may be affixed to the ends of rods 6, or may be affixed at a position offset from the ends, towards the center of rods 6.

Figure 3:
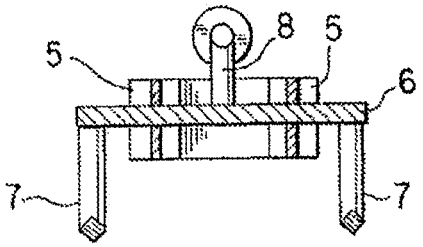
FIG. 3 is a sectional view of the lifting apparatus shown in FIG. 2, taken along line A-A.

As shown in FIGS. 1 and 3, arms 8 are affixed to the rods 6 in a suitable fashion, such as, for example, by welding. Arms 8 may extend from rods 6 in the upward direction (e.g., away from the ground). As shown in FIGS. 1 and 2, the lifting apparatus 1 includes an actuation device. The actuation device may include a hydraulic piston 9 with actuation members 10 and 11. However, according to some embodiments, the actuation device may include pneumatic or electric actuation devices, such as pneumatic or electric pistons or similar actuators. Thus, the various embodiments discussed below and shown in the figures are not intended to be limited to only one type of actuator, but may use any of hydraulic, pneumatic, or electric actuation for moving the apparatus.

In accordance with an embodiment of the invention, the actuation device may be operated by personnel from an appropriate distance by suitable connections and control equipment (not shown) as are known in the art. Activation of the piston 9 causes actuation members 10 and 11 to translate in a manner such that the ends of actuation members 10 and 11, 10*a* and 11*a*, respectively, move towards one another. The ends 10*a* and 11*a* of actuation members 10 and 11 are coupled to the top end of arms 8, as shown. Preferably, the coupling of ends 10*a* and 11*a* to arms 8 may be disengaged, to allow for maintenance and/or replacement of actuation device, or any of its component parts.

Figure 4:
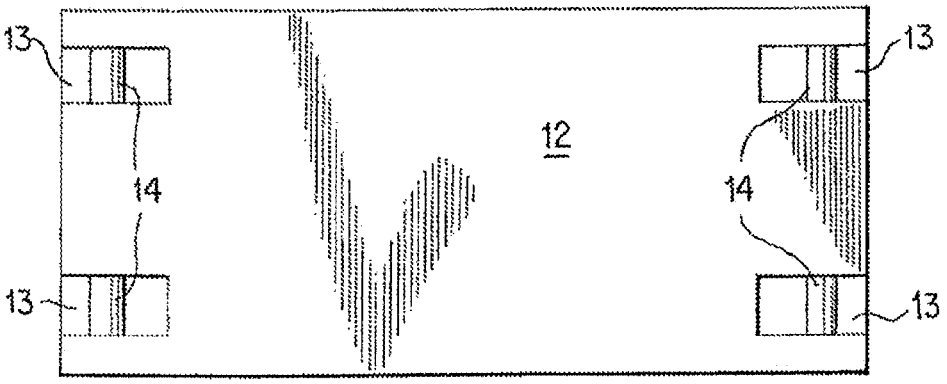
FIG. 4 is a top view of one type of manhole cover with which a lifting apparatus in accordance with one embodiment of the invention may be used.

FIG. 4 shows one type of manhole cover used to cover an access conduit that may be lifted and replaced using an embodiment of the lifting apparatus 1. Manhole cover 12 includes an interface structure. For example, the interface structure of manhole cover 12 may include a plurality of pockets 13. Integral with each pocket 13 is a lifting block 14 positioned such that lifting hook 7 may be inserted into the pocket 13 and under lifting block 14 to form an interface, or engagement, between the lifting hook 7 and the lifting block 14 and allow the manhole cover 12 to be lifted from the access conduit. Although the manhole cover 12 shown in FIG. 4 is a rectangular manhole cover, embodiments of the invention are not limited to lifting only rectangular manhole covers. For example, according to some embodiments of the present invention, the manhole cover may be round, triangular, clover-shaped, or any other shape used for manhole covers.

In operation, lifting apparatus 1 is affixed to an appropriate rigging structure at lifting points 3 by rigging lines 4. Rigging lines 4 may be affixed to appropriate rigging or lifting equipment, such as a crane or similar device. The lifting apparatus 1 is moved into a position over the manhole cover 12, and is lowered to allow lifting hooks 7 to be inserted into pockets 13. The piston 9 is then activated by personnel from a remote location. As described above, activation of the piston 9 causes ends 10*a* and 11*a* of actuation members 10 and 11 to move towards one another. Movement of ends 10*a* and 11*a* in this manner causes arms 8, rods 6, and lifting hooks 7 to rotate about the axis of rods 6. This rotation results in a secure interface between lifting hooks 7 and lifting blocks 14. After a secure interface is achieved, the lifting device 1 and the manhole cover 12 may be lifted as one piece by suitable rigging equipment, removing manhole cover 12 from the top of the access conduit.

To replace the manhole cover 12 onto the top of the access conduit, the lifting device 1 and manhole cover 12 are appropriately positioned over the access conduit, again using suitable rigging equipment. The lifting device 1 and manhole cover 12 are then lowered such that manhole cover 12 is placed on top of the access conduit. Piston 9 may then be de-actuated by personnel from a remote location such that ends 10*a* and 11*a* of actuation members 10 and 11 move away from one another. The movement of ends 10*a* and 11*a* in this manner causes arms 8, rods 6, and lifting hooks 7 to rotate about the axis of rods 6 in a rotational direction opposite from when the lifting hooks 7 of lifting apparatus 1 are being securely interfaced with the lifting blocks 14 of the manhole cover 12. This opposite rotation results in the release of lifting hooks 7 from lifting blocks 14. After release, the lifting apparatus 1 may be removed and the manhole cover 12 is securely replaced on the access conduit.

In view of the above description, it will be seen that the several objects of the invention are achieved and other advantageous results obtained. As various changes could be made to the embodiments described without departing from the scope of the invention, it is intended that all matter contained in the above description or shown in the accompanying drawings shall be interpreted as illustrative and not so as to limit the scope of the invention.

FIGS. 5A-5D are respectively perspective, top, side and end views of a manhole cover lifting apparatus 20 according to another embodiment of the invention. In the configuration shown, lifting apparatus 20 is particularly suited for lifting rectangular manhole covers such as rectangular manhole cover 12 shown in FIG. 4. However, as discussed above, the lifting apparatus 20 may be used for lifting manhole covers of different shapes, or for other applications involving lifting or lowering.

Lifting apparatus 20 includes a generally rectangular frame having longitudinal frame members 21*a*, 21*b* and lateral frame members 22*a*, 22*b*. Longitudinal frame members 21*a*, 21*b* and lateral frame members 22*a*, 22*b* are preferably made of metal, such as steel, and can be one of a number of possible constructions, including tubular, solid, or channel, among others. In the illustrated embodiment, longitudinal frame members 21*a*, 21*b* are of a channel construction and lateral frame members 22*a*, 22*b* are of a tubular construction.

A first pair of rectangular tubular members 23*a*, 23*b* attach lateral frame member 22*b* to longitudinal frame members 21*a*, 21*b*. In particular, each tubular support 23*a*, 23*b* includes an outer sidewall attached to a corresponding end of lateral frame member 22*b*, for example by welding or bolts. The inner sidewalls of rectangular tubular members 23*a*, 23*b* form a rectangular tube for receiving one end of a corresponding longitudinal frame member 21*a*, 21*b*. Together, rectangular tubular members 23*a*, 23*b* and lateral frame member 22*b* form an end assembly, which is preferably fixed relative to longitudinal frame members 21*a*, 21*b* during the lifting operations described below. Although tubular member 23*a* and 23*b* are shown as having rectangular cross-sections, the invention is not limited to this embodiment and may include members having any suitably-shaped cross-section.

Figure 5A:
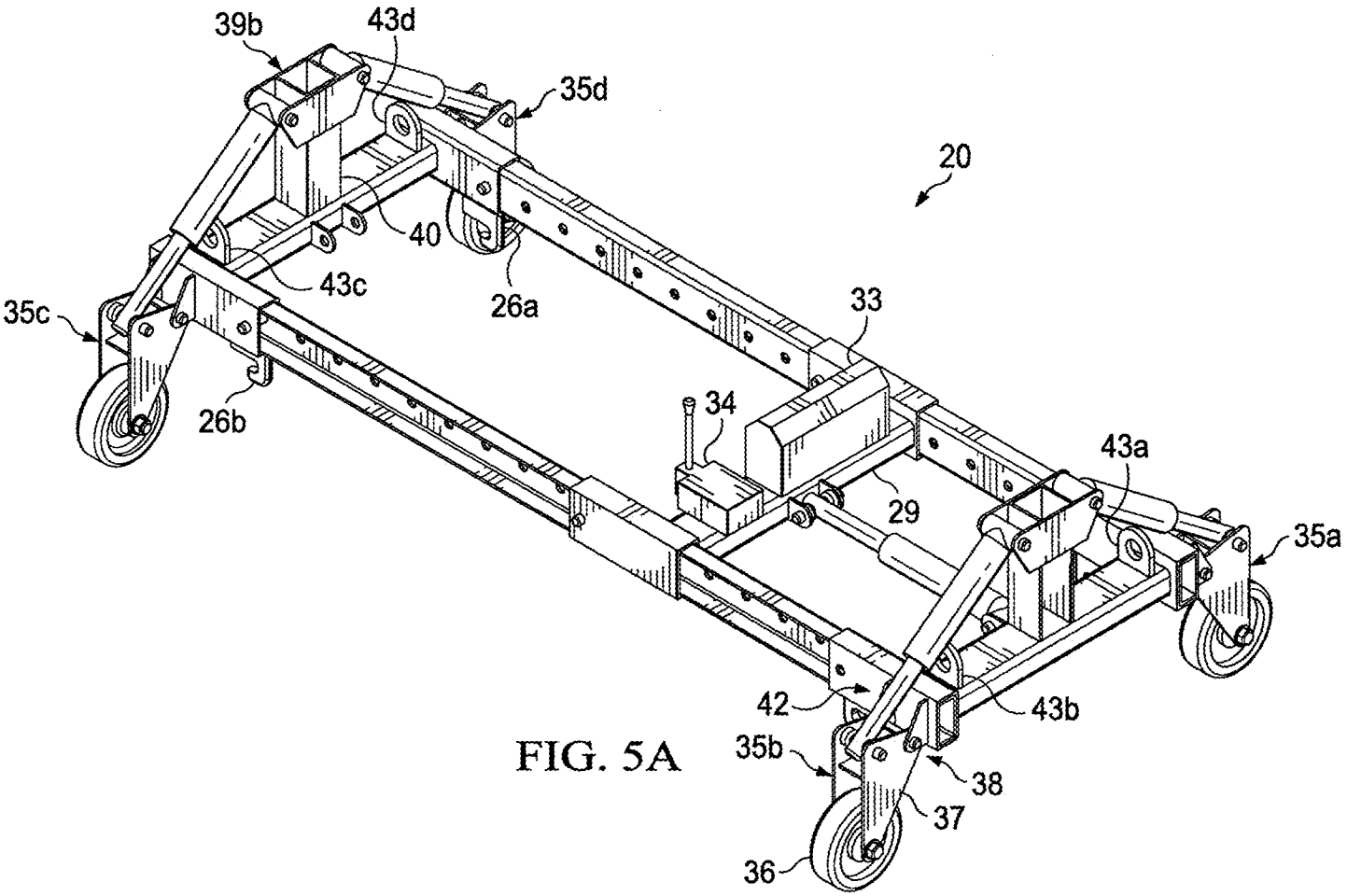
FIG. 5A is a perspective view of a lifting apparatus according another embodiment of the invention.
Figure 5B:
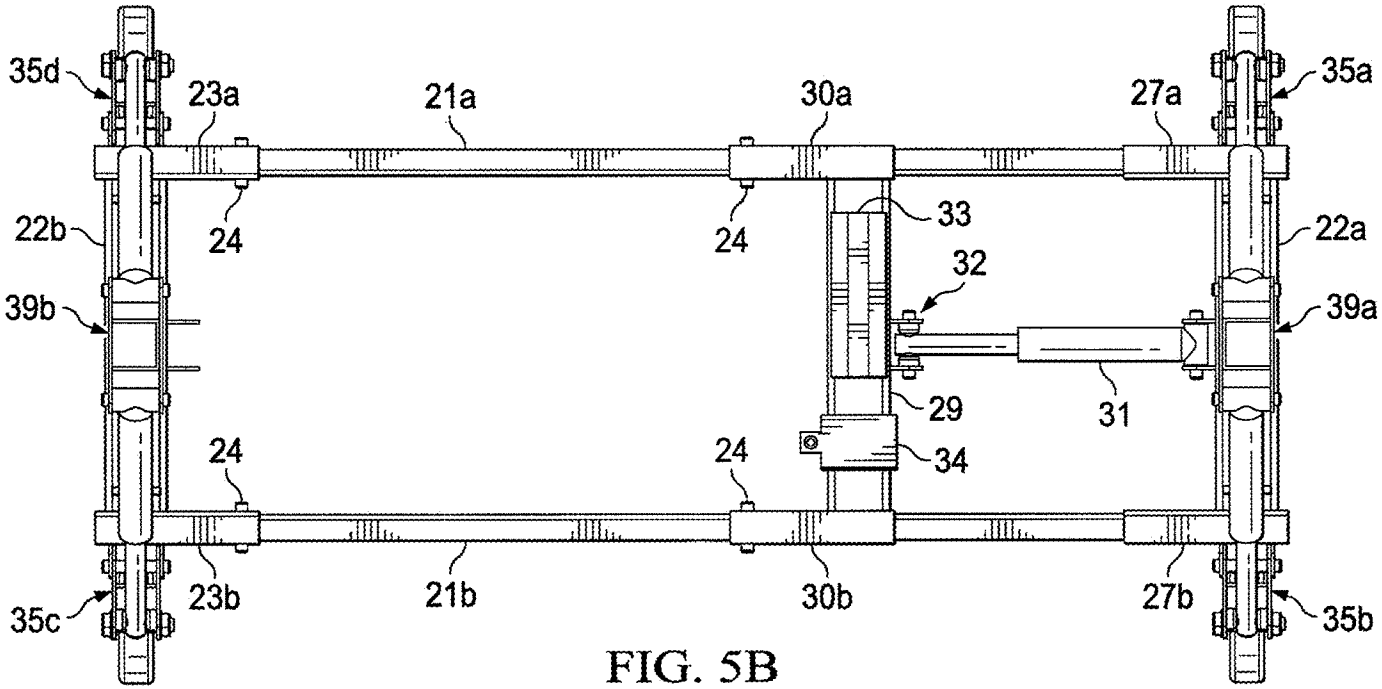
FIG. 5B is a top view of the lifting apparatus of FIG. 5A.
Figure 5C:
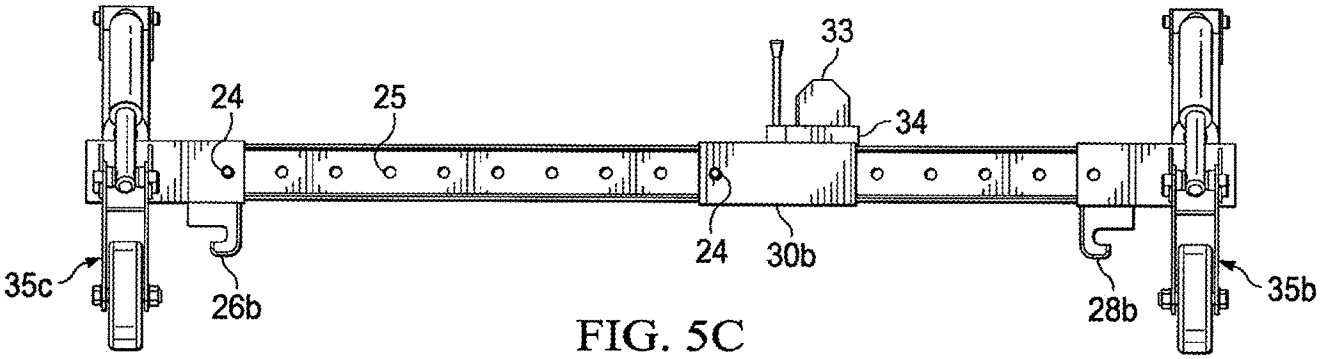
FIG. 5C is a side view of the lifting apparatus of FIG. 5A.

The fixed end assembly comprised of lateral frame member 22*b* and rectangular tubular members 23*a*, 23*b* is selectively positioned along longitudinal frame members 21*a*, 21*b* and held in place by bolts or pins 24 that extend through apertures 25 in the vertical walls of longitudinal frame members 21*a*, 21*b* (FIG. 5C). The position of the fixed end assembly (lateral frame member 22*b* and rectangular tubular members 23*a*, 23*b*) along longitudinal frame members 21*a*, 21*b* may change through the use of pins 24 and apertures 24, depending, for example, on the spacing of the lifting blocks 14 and pockets 13 on the manhole cover to be lifted.

A first set of hooks 26*a*, 26*b* extend downward from the bottom walls of rectangular tubular members 23*a*, 23*b*, respectively (FIG. 5A). In the illustrated embodiment, hooks 26*a*, 26*b* are adapted to engage one pair of lifting blocks 14 on manhole cover 12 of FIG. 4.

Figure 5D:
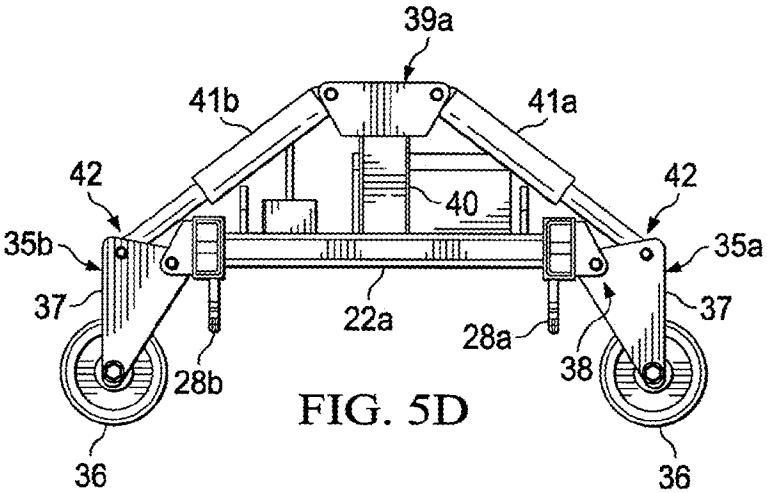
FIG. 5D is an end view of the lifting apparatus of FIG. 5A.

A second pair of rectangular tubular members 27*a*, 27*b* attach lateral frame member 22*a* to longitudinal frame members 21*a*, 21*b*. The end assembly comprised of rectangular tubular members 27*a*, 27*b* and lateral frame member 22*a* is allowed to move (i.e., slide) along a part of the length of longitudinal frame members 21*a*, 21*b* during lifting operations A second set of hooks 28*a*, 28*b* extend downward from the bottom walls of rectangular tubular members 27*a*, 27*b*, respectively (FIG. 5D). In the illustrated embodiment, hooks 28*a*, 28*b* are adapted to engage a second pair of lifting blocks 14 on manhole cover 12 of FIG. 4.

A central lateral support member 29 is supported between longitudinal frame members 21*a*, 21*b* by rectangular tubular members 30*a*, 30*b*. Central lateral support 29 is positioned along longitudinal frame members 21*a*, 21*b* and held into place with pins 24 and apertures 25. The position of central lateral support member 29 along longitudinal frame members 21*a*, 21*b* may change through the use of pins 24 and apertures 24, depending, for example, on the spacing of lifting blocks 14 and pockets 13 and the resulting required positioning of the movable end assembly of lateral frame member 22*a* and rectangular tubular members 27*a*, 27*b*.

The movable shaft of a horizontal piston assembly 31 attaches to central lateral support member 29 with assembly 32. The end of the body of horizontal piston assembly 31 is fastened to lateral frame member 22*a*. In some embodiments, central lateral support member 29 also supports a four-way hydraulic flow divider 33 and a control valve 34, both of which are discussed below.

Four wheel assemblies 35*a*-35*d* are located at corresponding corners of lifting apparatus 20. Each wheel assembly includes a wheel 36 and a wheel support bracket 37. Each wheel support bracket 37 pivots vertically in conjunction with assemblies 38 on corresponding rectangular tubular member pairs 23*a*, 23*b* and 27*a*, 27*b*.

In the illustrated embodiment, the pivoting of wheel assemblies 35*a*-35*d* is implemented with vertical units 39*a* and 39*b*, which in turn vertically raises and lowers lifting apparatus 20 to allow lifting and moving manhole cover 14.

Figure 11:
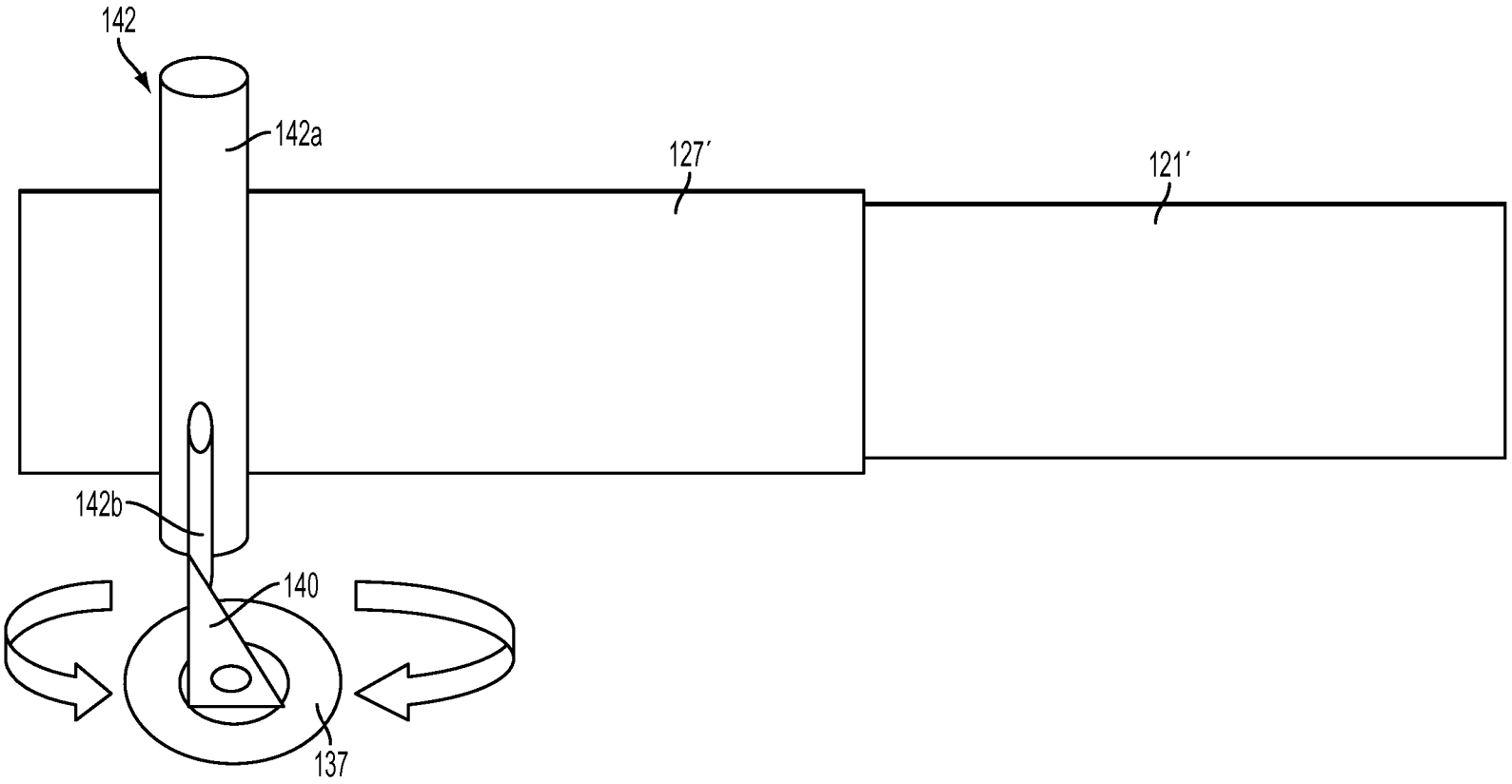
FIG. 11 shows a schematic of a lifting apparatus according to an embodiment of the invention.

Each of vertical units 39*a*, 39*b* includes a support structure 40 extending from lateral frame members 22*a*, 22*b* and vertical piston assemblies 41*a*, 41*b* extending at an angle downwardly from the top of support structure 40 (FIGS. 5A, and 5D). However, the vertical piston assemblies need not extend at a non-zero angle with respect to the vertical and may, for example, extend vertically (i.e., substantially 0 degrees with respect to the vertical) as shown in FIG. 11 and discussed further below. In the illustrated embodiment, the bodies of vertical piston assemblies 41*a*, 41*b* are attached to upper ends of the corresponding support structure 40 and the ends of the moving piston shafts are attached to a point on the corresponding wheel assembly support frame 37. Handles (not shown) may be inserted into the tubular structure of one or both of support structures 40 to allow manual movement of lifting apparatus 20.

Use of vertical units 39*a*, 39*b* is not required. In alternate embodiments, vertical movement units 39*a*, 39*b* may be eliminated from lifting apparatus 20 in their entirety. Lifting rings 43*a*-43*d* at the corners of lifting apparatus 20 are provided for engaging a crane or the like as an alternative means of raising and lowering lifting apparatus 20 and any engaged manhole cover.

For clarity, the conventional hydraulic hoses and hydraulic driving source used in some embodiments for actuating horizontal piston assembly 31 and vertical piston assemblies 41*a*, 41*b* are not shown. Generally, conventional horizontal piston assembly 31 includes two hydraulic ports, one for receiving fluid under pressure to extend the piston shaft and another for receiving fluid under pressure for retracting the piston shaft. Each of these ports is connected by a hose and couplings to a corresponding port on control valve 34. Control valve 34 also includes another of ports that exchange fluid through a pair of hoses with a conventional hydraulic pump or pressure unit.

Four-way hydraulic flow divider 33 may exchange fluid under pressure with a conventional hydraulic pump or pressure unit through a pair of hoses. Each vertical piston assembly 41 may include two ports, one for extending the piston shaft and one for retracting the piston shaft. Two hoses may then be provided between four-way hydraulic flow divider 33 and each of the four vertical piston assemblies 41 to provide pressure for lifting and lowering lifting apparatus 20.

In operation, lifting apparatus 20 is positioned such that hooks 26*a*, 26*b* and 28*a*, 28*b* are within pockets 13 of manhole cover 12, and aligned, but not yet engaged, with lifting blocks 14. In embodiments with wheel assemblies 35*a*-35*d* and vertical movement units 39*a*, 39*b*, lifting apparatus is rolled into place and wheel assemblies 35*a*-35*d* rotated upward to lower hooks 26*a*, 26*b* and 28*a*, 28*b* into pockets 13. If only hooks 43*a*-43*d* are available or being used, then lifting apparatus 20 can be lowered into position with a crane.

Once the hooks are in position, piston assembly 31 is manually activated using control valve 33. As the shaft of piston assembly 31 extends, the movable end assembly (rectangular tubular members 27*a*, 27*b* and lateral frame member 22*a*) slides outward along longitudinal frame members 21*a*, 21*b* and away from central lateral member 29. The corresponding end of lifting assembly slides on the surfaces of the corresponding wheels 36 until hooks 28*a*, 28*b* engage the corresponding lifting blocks 14.

The pressure provided to piston assembly 31 now forces fixed central lateral support member 29 away from the now engaged hooks 28*a*, 28*b*, which continues to increase the distance between hooks 28*a*, 28*b* and hooks 26*a*, 26*b*. This causes hooks 26*a*, 26*b* on the fixed end assembly (lateral frame member 22*b* and rectangular tubular members 23*a*, 23*b*) to slide outward into their corresponding lifting blocks 14. Piston assembly 31 continues to increase the lateral force until all of hooks 28*a*, 28*b* and hooks 26*a*, 26*b* are forced into hard engagement with the corresponding lifting blocks 14. Lifting apparatus 20 is now secured to manhole cover 12.

In other words, piston assembly 31 expands the distance between fixed hooks 26*a*, 26*b* and movable hooks 28*a*, 28*b* until lifting apparatus 20 is securely engaged with manhole cover 20.

In embodiments with wheel assemblies 35*a*-35*d* and vertical movement units 39*a*, 39*b*, the operating personnel can move to a safe distance from the manhole cover 14 being lifted. For example, hydraulic fluid under pressure is then remotely provided to piston assemblies 41*a*, 41*b* causing wheel assemblies 35*a*, 35*b* to rotate downward and lift manhole cover 12 upward. Lifting apparatus 20 and engaged manhole cover 12 can be subsequently rolled away from the access conduit. Alternatively, lifting apparatus and engaged manhole cover 12 can be lifted using a crane and hooks 43*a*, 43*b*.

To replace manhole cover 12, lifting apparatus 20 and engaged manhole cover 12 are rolled back into alignment with the access conduit and the hydraulic pressure on piston assemblies 41*a*, 41*b* is released. Wheel assemblies 35*a*-35*d* pivot upward and cover 12 is lowered downward to the access conduit. Alternatively, lifting apparatus and engaged manhole cover 12 are returned to the access conduit using a crane and hooks 43*a*-43*d*. In each case, lifting apparatus 20 is disengaged from manhole cover 12 by retracting dynamic lateral frame member 22*a* with piston assembly 31 and control valve 34.

FIGS. 6 through 10B show a rectangular manhole cover lifting apparatus 120 according to another embodiment of the invention. The lifting apparatus 120 includes a first frame section 150*a* and a second frame section 150*b* (See FIG. 7). The first frame section 150*a* includes a first end assembly 122*b*, 123*a*, 123*b* that supports one or more hooks 126*a*, 126*b*. The hooks 126*a*, 126*b* may be designed to engage, for example, a corresponding lifting block 14 on a manhole cover 12 (See FIG. 4). The second frame section 150*b* includes a second end assembly 122*a*, 127*a*, 127*b* that supports one or more hooks 128*a*, 128*b* that can engage a corresponding lifting block 14 on the manhole cover 12. At least one of the first and second end assemblies can be movable with respect to the other end assembly. In this way, the distance between hooks 128*a*, 128*b* and hooks 126*a*, 126*b* of the first and second end assemblies, respectively, can be adjusted.

The lifting apparatus 120 may also include an actuator 131 to move at least one of the first and second end assemblies to increase the distance between the hooks 128*a*, 128*b* and hooks 126*a*, 126*b* such that the hooks engage with the lifting blocks on an adjacent manhole cover. According to this embodiment, the first frame section 150*a* may be coupled to the second frame section 150*b* during a lifting operation. However, the first and second frame sections 150*a*, 150*b* may also be selectively detachable from one another when not in use. Accordingly, a manhole cover lifting apparatus can be provided that is easier to transport because it can be carried in sections. For example, an operator of the lifting apparatus may carry only one section at a time, thus lightening the load carried. In addition, the lifting apparatus can be stored more efficiently by detaching the first and second frame sections and positioning or stacking them side-by-side. In some embodiments, the lifting apparatus may have a corresponding bracket for holding the un-connected sections of the lifting apparatus within a vehicle.

As discussed elsewhere, the actuator 131 may be a piston, such as a hydraulic piston, pneumatic piston, or electric piston. The lifting apparatus 120 may further include a lifting system 139*a*, 139*b* coupled to each of the first and second end assemblies for raising the first and second frame sections 150*a*, 150*b* and an engaged manhole cover.

The lifting apparatus may also include a frame connection section (129, 130*a*, 130*b*) that can couple the first frame section 150*a* to the second frame section 150*b*. For example, a portion of at least one of the first and second frame sections 150*a*, 150*b* may be slideably received within the frame connection section. The first and second frame sections 150*a*, 150*b* may then be fixed with respect to the frame connection section. The frame connection section can include an elongated member 129 and a pair of tubes 130*a*, 130*b*. The tubes 130*a*, 130*b* may each have an outer wall coupled to a corresponding end of the elongated member 129 and inner walls defining a space for receiving portions of the first and second frame sections 150*a*, 150*b*. The tubes 130*a*, 130*b* may include apertures through their outer and inner walls for fasteners 124, 144 that can be inserted through corresponding apertures and walls of the received portions of the first and second frame sections 150*a*, 150*b*.

According to some embodiments, the first frame section 150*a* may include a first pair of generally parallel longitudinal members 121*a*, 121*b*. The second frame section 150*b* may include a second pair of generally parallel longitudinal members 121*c*, 121*d*. A pair of generally parallel lateral assemblies 122*a*, 122*b* of the first and second end assemblies can each be respectively coupled to and spacing one of the first or second pair of longitudinal members 121*a*, 121*b* and 121*c*, 121*d*. At least one of the lateral assemblies 122*a*, 122*b* can be movable along a portion of the length of one of the first or second pair of longitudinal members 121*a*, 121*b* and 121*c*, 121*d*. The actuation device 131 may move at least one of the movable lateral assemblies 122*a*, 122*b* along a portion of the length of the first or second pair of longitudinal frame members to increase or decrease a spacing between the lateral assemblies 122*a*, 122*b*. For example, the lateral assembly 122*a* or 122*b* may slide along a portion of the length of the first or second pair of longitudinal members.

The second pair of longitudinal members 121*c*, 121*d* may be coupled to the first pair of longitudinal members 121*a*, 121*b* during a lifting operation. Additionally, the second pair of longitudinal members 121*c*, 121*d* may be selectively detachable from the first pair of longitudinal members 121*a*, 121*b* when not in use. For example, the frame connection section (129, 130*a*, 130*b*) may space at least one of the first and second pairs of longitudinal members at a point between the pair of lateral assemblies 122*a*, 122*b*. Additionally, a piston of the actuation device 131 may apply a force between the elongated member 129 and at least one of the movable lateral assemblies 122*a*, 122*b*.

The lifting apparatus 120 may also include two pairs of wheels 36 on pivoting wheel assemblies 135*a*-135*d* respectively coupled to opposing ends of each lateral assembly 122*a*, 122*b*. A piston system 141*a*, 141*b* supported by each lateral assembly 122*a*, 122*b* may be used to pivot the corresponding pairs of wheel assemblies about pivot point 138 (FIG. 9) to raise the lifting apparatus and the engaged manhole cover.

The movable lateral assemblies may each include an elongated member 122*a* or 122*b*, and a pair of tubes 127*a*, 127*b* each having an outer wall coupled to a corresponding end of the elongated member 122*a*, 122*b* and inner walls for receiving corresponding longitudinal members 121*a*-121*d* such that the movable lateral member 122*a* is allowed to slide along a length of the pair of longitudinal members in response to the actuation device.

According to an embodiment, the four-way flow divider discussed above may replaced with two or more flow dividers, with at least one flow divider being disposed on the first frame section 150*a* and at least one other flow divider being disposed on the second frame section 150*b*, for example. Accordingly, better balance of the lifting apparatus can be achieved, for example.

According to an embodiment, as shown in FIG. 11, each wheel 137 is provided on a wheel assembly 140. In this embodiment, the lifting apparatus need not be lifted via pivoting wheel assemblies. Instead, the wheel assembly 140 may be coupled to a vertical actuation device 142. The vertical actuation device 142 may include, for example, a piston 142*b* that is coupled to the wheel assembly 140 and that extends from an actuation cylinder 142*a*. The actuation cylinder 142*a* may be fixed to a tube 127' on longitudinal member 121'. The tube 127' may correspond to one of tubes 123*a*-*b* and 127*a*-*b* and longitudinal member 121' may correspond to one of parallel longitudinal members 121*a*-*d* of the above-discussed embodiments. Therefore, the piston 142*b* may extend from the actuation cylinder 142*a* in a vertical direction such that a distance between the wheel 137 and the actuation cylinder 142*a* is increased or decreased to raise or lower a manhole cover. While the raising of the manhole cover is not accomplished by pivoting wheel assemblies according to this embodiment, each wheel 137 may nonetheless pivot about a vertical axis as indicated by the rotational arrows in FIG. 11. In an alternative arrangement, each actuation cylinder 142*a* may be fixed to one of the parallel lateral assemblies 122*a*, 122*b*.

According to another embodiment of the current invention, a method for removing a manhole cover from an access conduit is provided. The method includes providing a lifting apparatus 120, and coupling the first frame section 150*a* to the second frame section 150*b* prior to removing the manhole cover. The method also includes positioning the lifting apparatus 120 adjacent to a manhole cover 12 including a plurality of lifting blocks 14 and activating an actuator 131 to increase the distance between the hooks to engage the hooks with the lifting blocks on the adjacent manhole cover. The method further includes raising the lifting apparatus 120 after the hooks are engaged with the lifting blocks to lift the manhole cover. When coupling the first frame section 150*a* to the second frame section 150*b*, the method may also include slideably engaging at least one of the first and second frame sections 150*a*, 150*b* with a frame connection system.

Figure 6:
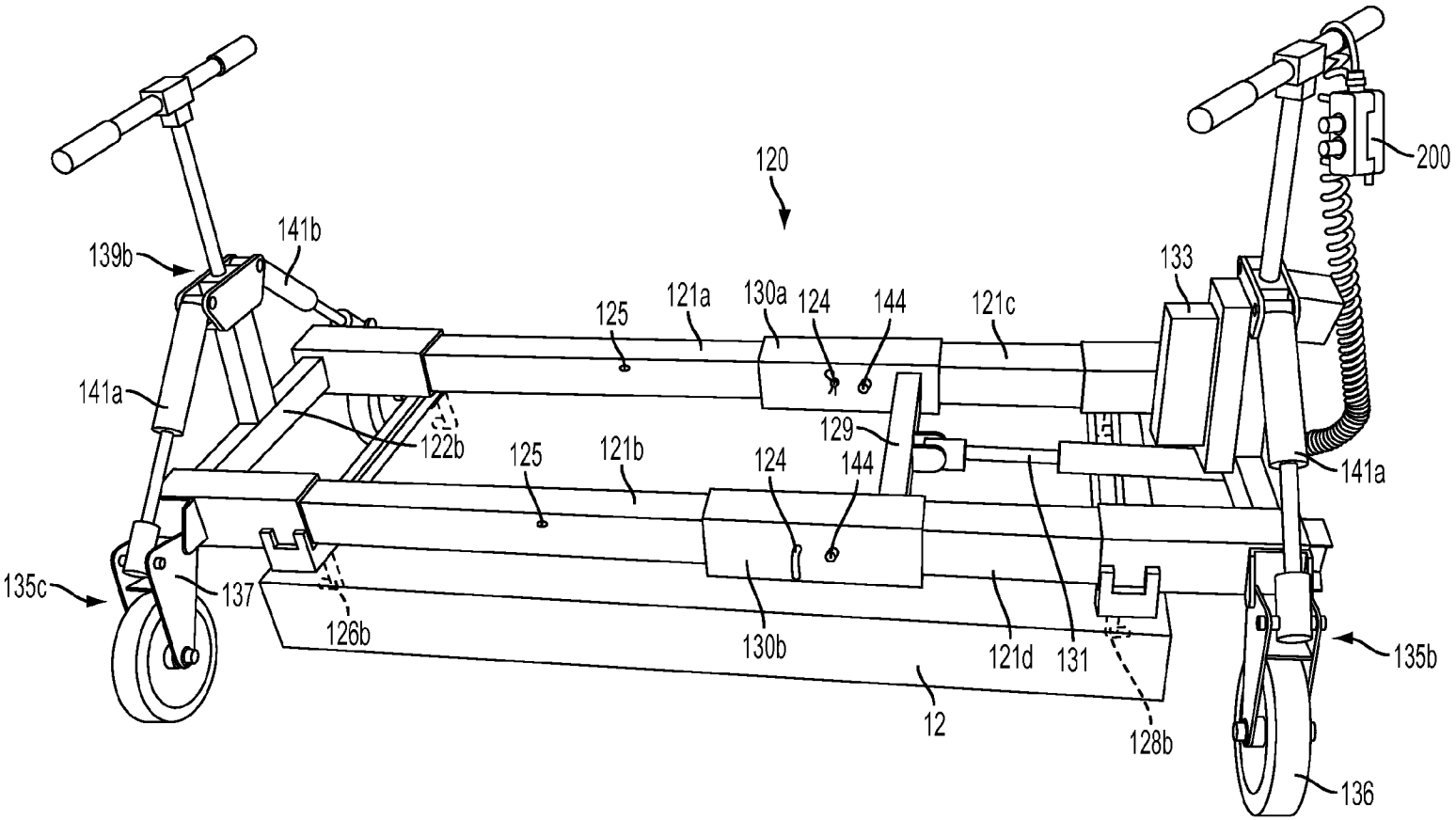
FIG. 6 is a perspective view of a lifting apparatus according to another embodiment of the invention.
Figure 7:
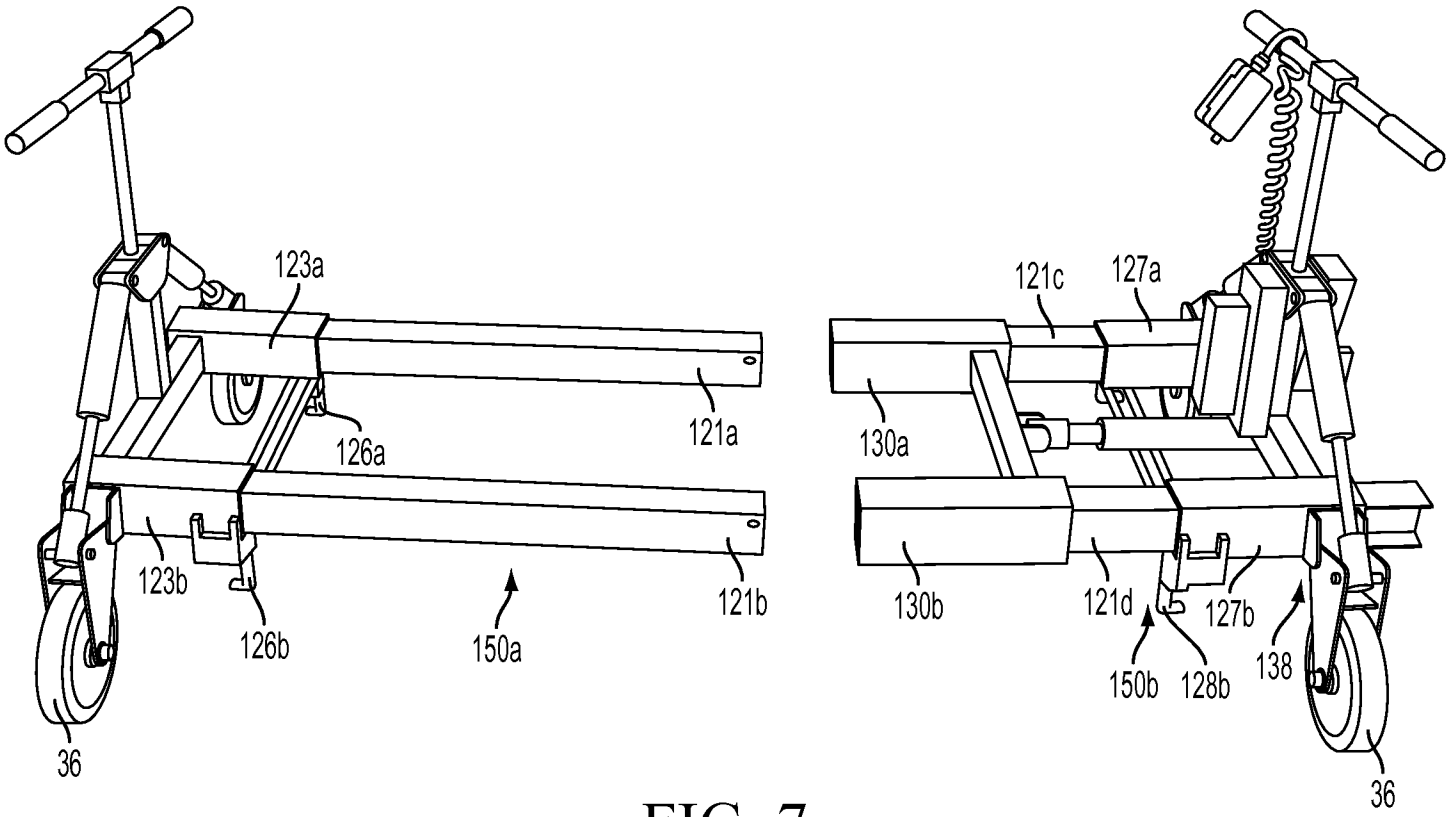
FIG. 7 is a perspective view of the lifting apparatus of FIG. 6 according to an embodiment of the invention.
Figure 8A:
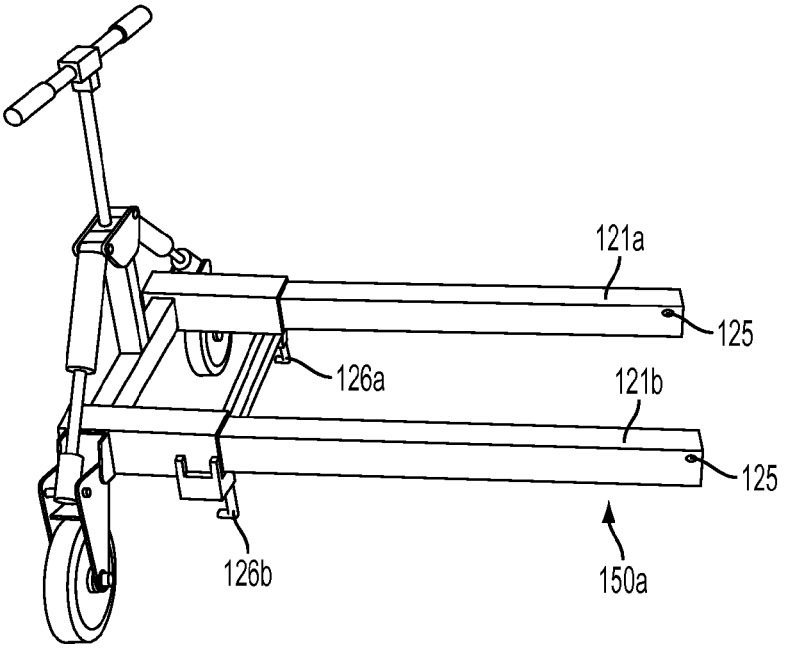
FIG. 8A is a perspective view of one half of the lifting apparatus of FIG. 6 according to an embodiment of the invention.
Figure 8B:
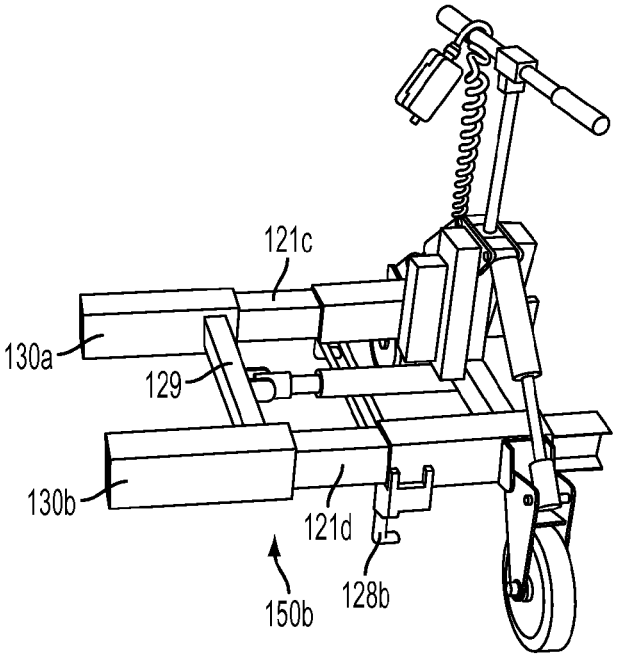
FIG. 8B is a perspective view of a second half of the lifting apparatus of FIG. 6 according to an embodiment of the invention.
Figure 9:
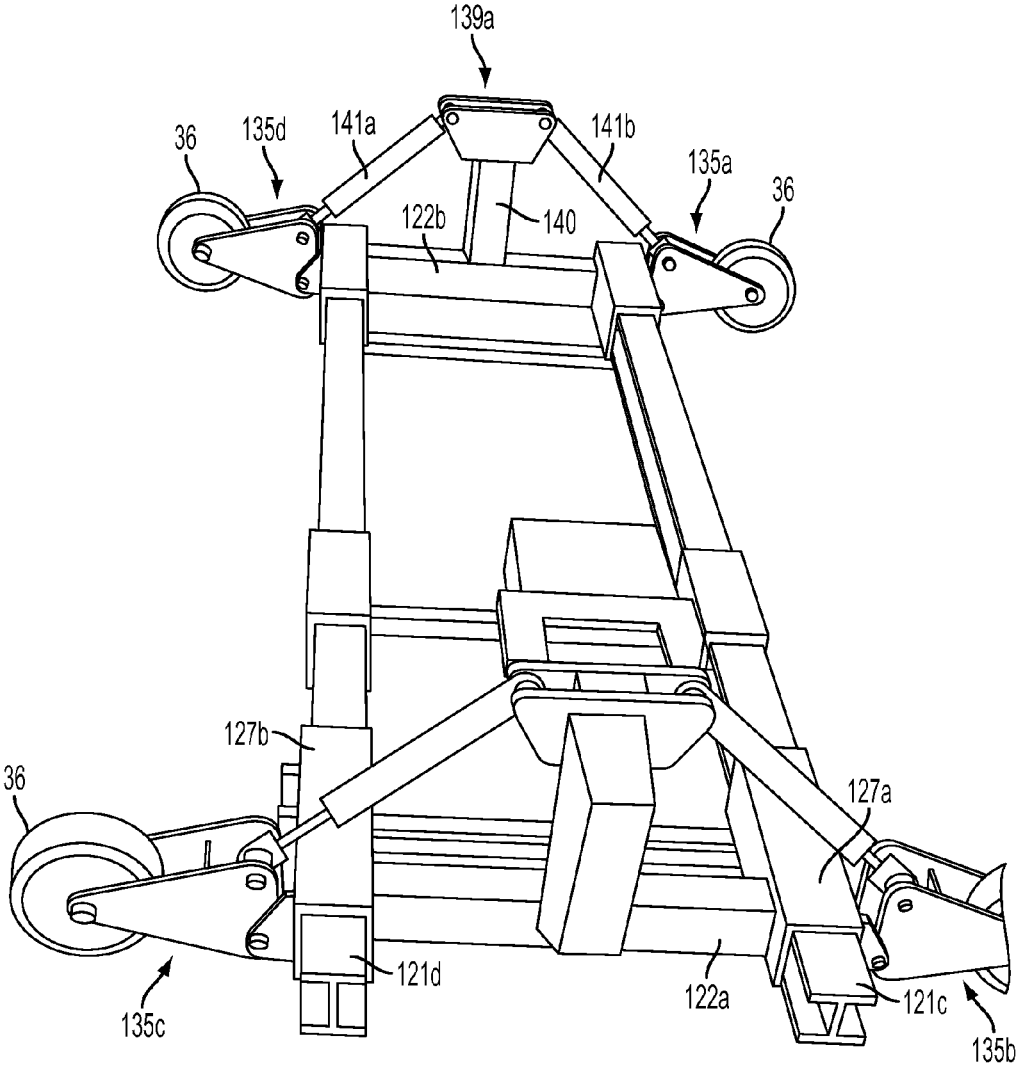
FIG. 9 is a perspective view of the lifting apparatus of FIG. 6 according to an embodiment of the invention.
Figure 10A:
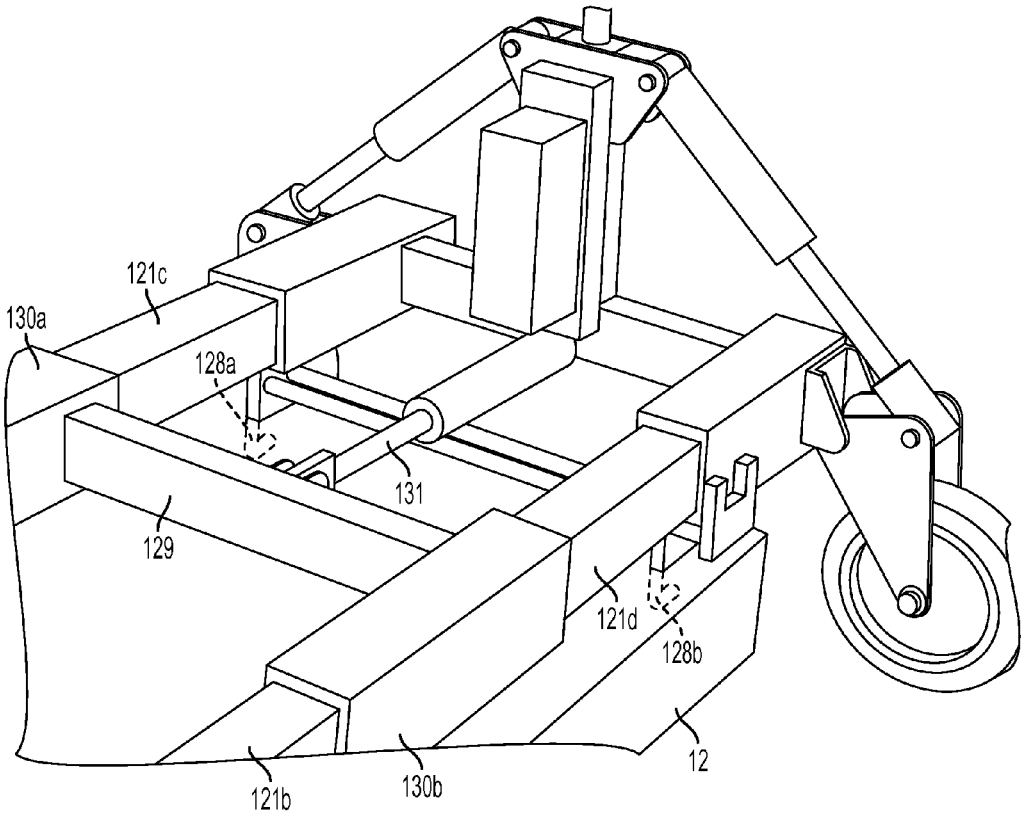
FIG. 10A is a perspective view of a portion of the lifting apparatus of FIG. 6 according to an embodiment of the invention.
Figure 10B:
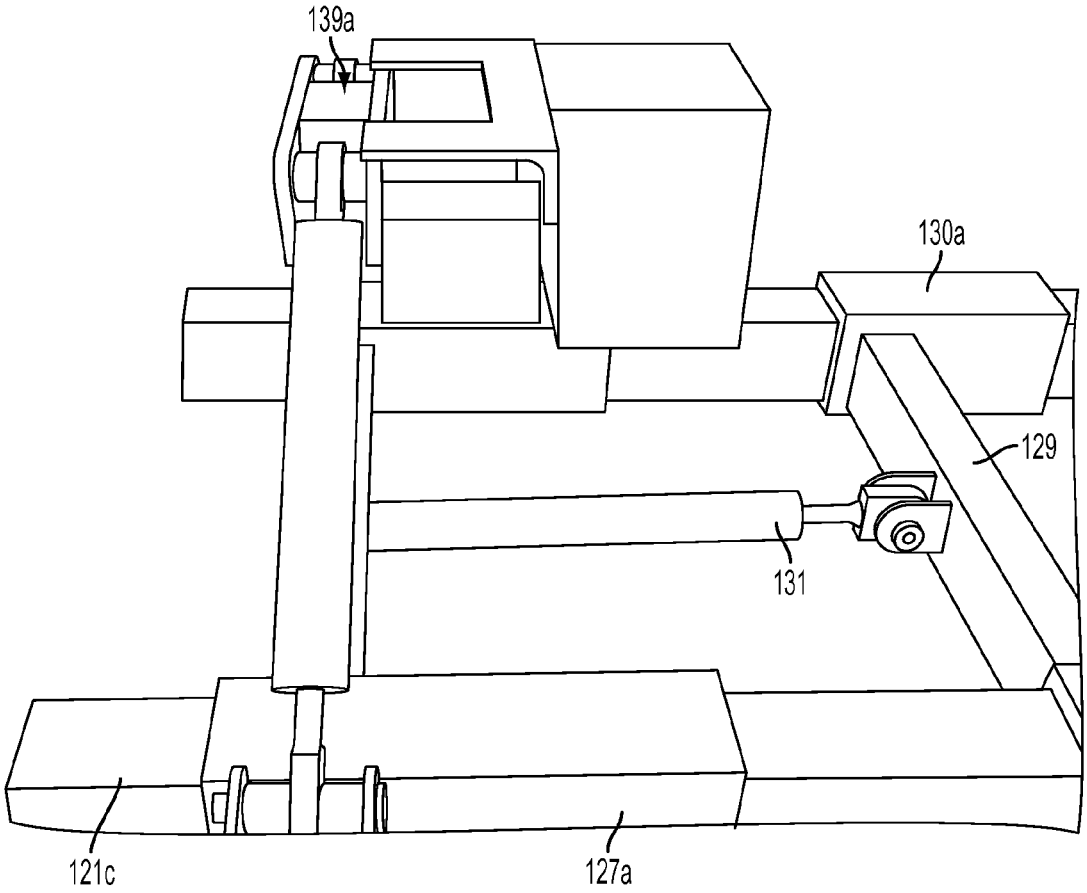
FIG. 10B is a perspective view of a portion of the lifting apparatus of FIG. 6 according to an embodiment of the invention.

The actuation devices and piston system in the above embodiments can be operated by personnel from an appropriate distance by suitable connections and control equipment. For example, the actuation devices and piston system may be controlled electronically using a control module 200, as shown in FIG. 6. The embodiment shown in FIG. 6 is wired to the lifting apparatus, however, the control module could be a wireless control module. Using the control module 200, an operator of the lifting apparatus may control the position of the hooks for engaging and disengaging the manhole cover. Also, the operator may control the raising and lowering of the lifting apparatus.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

What is claimed is:

1. A lifting apparatus for lifting a manhole cover comprising:

a first frame section having a first end assembly that supports a hook adapted to engage a corresponding lifting block on a manhole cover;

a second frame section having a second end assembly that supports a hook adapted to engage a corresponding lifting block on the manhole cover, at least one of the first and second end assemblies being movable with respect to the other of the first and second end assemblies to change a distance between the hooks of the first and second end assemblies;

a frame connection section including an elongated member, and a pair of tubes each having an outer wall coupled to a corresponding end of the elongated member and inner walls defining a space for receiving portions of the first and second frame sections; and an actuator configured to move at least one of the first and second end assemblies to increase the distance between the hooks such that the hooks engage with the lifting blocks on the manhole cover, wherein the first frame section is coupled to the second frame section during a lifting operation, and the first and second frame sections are selectively detachable from one another when not in use, wherein the frame connection section is configured to couple the first frame section to the second frame section by slideably receiving a portion of at least one of the first and second frame sections, and fixing positions of each of the first and second frame sections with respect to the frame connection section, wherein the pair of tubes include apertures through the outer and inner walls of each of the pair of tubes, the apertures arranged to receive fasteners for insertion through corresponding apertures and walls of the received portions of the first and second frame sections, and wherein the hooks of the first and second end assemblies are adapted to engage the corresponding lifting blocks on the manhole cover by being inserted under at least a portion of the lifting blocks.

2. The lifting apparatus of claim 1, wherein the actuator comprises a piston.

3. The lifting apparatus of claim 2, where the piston comprises a hydraulic piston, a pneumatic piston, or an electric piston.

4. The lifting apparatus of claim 1, further comprising a hydraulic lifting system coupled to each of the first and second end assemblies for raising the first and second frame sections and an engaged manhole cover.

5. A lifting apparatus for engaging a manhole cover, comprising:

a first pair of generally parallel longitudinal members of a selected length;

a second pair of generally parallel longitudinal members of a selected length, the second pair of longitudinal members being coupled to the first pair of longitudinal members during a lifting operation, and selectively detachable from the first pair of longitudinal members when not in use;

a pair of generally parallel lateral assemblies respectively coupled to the first and second pair of longitudinal members and respectively spacing the first and second pair of longitudinal members, wherein at least one of the lateral assemblies is movable along a portion of the length of one of the first or second pair of longitudinal members;

at least one hook supported by each lateral assembly for engagement with a corresponding lifting block provided at a face of a manhole cover;

an actuation device for moving the at least one of the lateral assemblies that is movable along a portion of the length of the first or second pair of longitudinal members to increase a spacing between the pair of lateral assemblies such that the at least one hook engages with the corresponding lifting blocks and secure the lifting apparatus to the manhole cover; and a central lateral assembly spacing at least one of the first and second pairs of longitudinal members at a point between the pair of lateral assemblies, wherein the actuation device comprises a piston for applying a force between the central lateral assembly and the at least one movable lateral assembly.

6. The lifting apparatus of claim 5, wherein the actuation device comprises a hydraulic piston, a pneumatic piston, or an electric piston.

7. The lifting apparatus of claim 5, wherein the at least one of the lateral assemblies that is movable slides along a portion of the length of the first or second pair of longitudinal members.

8. The lifting apparatus of claim 5, wherein the central lateral assembly comprises:

an elongated member; and a pair of tubes each having an outer wall coupled to a corresponding end of the elongated member and inner walls defining a space for slideably receiving portions of the first and second pairs of longitudinal members.

9. The lifting apparatus of claim 5, wherein the at least one hook comprises four lifting hooks spaced apart for insertion under four corresponding lifting blocks provided at the face of the manhole cover, one pair of the four lifting hooks supported by each lateral assembly.

10. The lifting apparatus of claim 5, further comprising an actuator system for raising the manhole cover.

11. The lifting apparatus of claim 10, wherein the actuator system comprises:

a pair of pivoting wheel assemblies coupled to opposing ends of each lateral assembly; and a piston system supported by each lateral assembly for pivoting the corresponding pairs of wheel assemblies to raise the lifting apparatus and the engaged manhole cover.

12. The lifting apparatus of claim 11, wherein the piston system supported by each lateral assembly for pivoting the corresponding pairs of wheel assemblies comprises:

a support structure extending at an angle from the lateral assembly;

a first piston extending at an angle from an end of the support structure to a first wheel assembly of the pair of wheel assemblies; and a second piston extending at an angle from the end of the support structure to a second wheel assembly of the pair of wheel assemblies.

13. The lifting apparatus of claim 5, wherein the at least one of the lateral assemblies that is movable comprises:

an elongated member; and a pair of tubes each having an outer wall coupled to a corresponding end of the elongated member and inner walls for receiving corresponding longitudinal members of one of the first and second pairs of longitudinal members such that the at least one movable lateral member is allowed to slide along a length of the first or second pair of longitudinal members in response to the actuation device.

14. The lifting apparatus of claim 5, wherein at least one of the lateral assemblies that is movable comprises:

an elongated member; and a pair of tubes each having an outer wall coupled to a corresponding end of the elongated member and inner walls for receiving corresponding longitudinal members of one of the first and second pairs of longitudinal members, wherein an aperture through the outer and inner walls of each of the pair of tubes is provided for receiving an fastener for insertion through a corresponding aperture through a wall of the received longitudinal member and attaching the at least one lateral assembly at a selected position along the length of the received longitudinal member.

15. The lifting apparatus of claim 14, wherein the at least one hook is attached to a lower outer wall of each of the pair of tubes.

16. A method for removing a manhole cover from an access conduit, comprising:

providing a lifting apparatus, the lifting apparatus comprising:

a first frame section having a first end assembly that supports a first hook adapted to engage a first lifting block of the manhole cover, a second frame section configured to be coupled to the first frame section and having a second end assembly that supports a second hook adapted to engage a second lifting block of the manhole cover, at least one of the first and second end assemblies being movable with respect to the other end assembly to change a distance between the first and second hooks, and an actuator for moving the at least one movable end assembly;

coupling the first frame section to the second frame section prior to removing the manhole cover;

positioning the lifting apparatus adjacent to the manhole cover;

activating the actuator to increase the distance between the first and second hooks to engage the first and second hooks with the first and second lifting blocks, respectively, on the adjacent manhole cover; and raising the lifting apparatus after the first and second hooks are engaged with the first and second lifting blocks to lift the manhole cover, wherein the actuator comprises a piston rod and the activating of the actuator comprises extending the piston rod to move the movable end assembly.

17. The method of claim 16, wherein the piston rod is at least one of a hydraulic piston, a pneumatic piston, and an electric piston.

18. The method of claim 16, wherein the lifting apparatus further comprises:

a pair of pivoting wheel assemblies coupled to opposing ends of each of the first and second end assemblies; and an actuation system for pivoting the wheel assemblies, wherein raising the lifting apparatus comprises activating the actuation system to pivot the wheel assemblies to raise the lifting apparatus.

19. The method of claim 16, wherein the lifting apparatus further comprises:

a plurality of wheel assemblies coupled to lower ends of each of the first and second end assemblies; and an actuation system including at least one piston rod, a lower end of the at least one piston rod being coupled to at least one of the plurality of wheel assemblies, wherein the actuation system is configured to move the piston rod in a vertical direction, and wherein the raising of the lifting apparatus comprises activating the actuation system to extend the piston rod in the vertical direction such that a distance between the plurality of wheel assemblies and the first and second hooks increases to raise the lifting apparatus.

20. The method of claim 16, wherein the lifting apparatus further comprises a frame connection section, and the coupling of the first frame section to the second frame section comprises slideably engaging at least one of the first and second frame sections with the frame connection section.

* * * * *